US007770255B2

(12) United States Patent
Zahuranec et al.

(10) Patent No.: US 7,770,255 B2
(45) **Date of Patent: *Aug. 10, 2010**

(54) VACUUM CLEANER WITH DRIVE ASSIST

(75) Inventors: Terry L. Zahuranec, North Olmsted, OH (US); David Scott Smith, Avon Lake, OH (US)

(73) Assignee: The Scott Fetzer Company, Westlake, OH (US)

( * ) Notice: Subject to any disclaimer, the term of this patent is extended or adjusted under 35 U.S.C. 154(b) by 12 days.

This patent is subject to a terminal disclaimer.

(21) Appl. No.: 12/345,827

(22) Filed: Dec. 30, 2008

(65) Prior Publication Data

US 2009/0133215 A1 May 28, 2009

Related U.S. Application Data

(63) Continuation of application No. 11/207,490, filed on Aug. 19, 2005, now Pat. No. 7,487,569.

(51) Int. Cl.
*A47L 5/00* (2006.01)

(52) U.S. Cl. ..... 15/340.2; 180/193; 15/319; 15/389; 15/390

(58) Field of Classification Search ..... 15/340.2, 15/319, 389, 390; *A47L 5/00*
See application file for complete search history.

(56) References Cited

U.S. PATENT DOCUMENTS

| | | | | |
|---|---|---|---|---|
| 2,138,239 | A | 11/1938 | Irgens | |
| 3,962,746 | A | 6/1976 | Johnson et al. | |
| 4,249,281 | A | 2/1981 | Meyer et al. | |
| 4,615,071 | A | 10/1986 | Frohbieter | |
| 4,624,027 | A | 11/1986 | Martin | |
| 4,766,640 | A | 8/1988 | Martin | |
| 5,285,550 | A | 2/1994 | Meyer et al. | |
| 5,974,622 | A | 11/1999 | Louis et al. | |
| 6,061,869 | A | 5/2000 | Ettes et al. | |
| 6,108,862 | A | 8/2000 | Frederick et al. | |
| 6,131,238 | A | 10/2000 | Weber et al. | |
| 6,158,084 | A | 12/2000 | Weber et al. | |
| 6,282,747 | B1 | 9/2001 | Morgan et al. | |
| 7,487,569 | B2 * | 2/2009 | Zahuranec et al. | 15/340.2 |
| 2004/0134018 | A1 | 7/2004 | Conner et al. | |
| 2004/0134019 | A1 | 7/2004 | Cipolla et al. | |
| 2004/0134020 | A1 | 7/2004 | Conner et al. | |
| 2004/0135537 | A1 | 7/2004 | Conner et al. | |
| 2006/0021182 | A1 | 2/2006 | Kim et al. | |

* cited by examiner

*Primary Examiner*—David A Redding
(74) *Attorney, Agent, or Firm*—Jones Day

(57) ABSTRACT

A base has wheels, including a drive wheel, for wheeling the base over a floor. A nozzle is fixed to the base for a fan in the base to draw air from the floor through the nozzle. A handle is connected to the base for propelling the base by manually applying a force to the handle. A drive assist motor, which is not configured to drive the fan, has an output shaft coupled to the drive wheel. The controller is operative in a driving mode to power the motor to rotate the drive wheel in a direction corresponding to a direction of the force applied to the handle. The controller is operative in a non-driving mode to refrain from powering the motor to rotate the drive wheel.

12 Claims, 2 Drawing Sheets

VACUUM CLEANER WITH DRIVE ASSIST

CROSS REFERENCE TO RELATED APPLICATION

This is a continuation of U.S. patent application Ser. No. 11/207,490, filed Aug. 19, 2005 now U.S. Pat. No. 7,487,569, hereby incorporated herein by reference

TECHNICAL FIELD

This technology relates to a vacuum cleaner.

BACKGROUND

A vacuum cleaner is used to remove dirt from a floor. The cleaner includes a base, a handle extending upward from the base, and front and rear wheels for wheeling the base over the floor. A user manually applies a forward or rearward force to the handle to propel the base forward or rearward. A drive assist assembly in the base rotates the rear wheels in a direction that corresponds to the direction of the force applied to the handle. The assembly thus assists the user in wheeling the base over the floor.

SUMMARY

A base has wheels, including a drive wheel, for wheeling the base over a floor. A nozzle is fixed to the base for a fan in the base to draw air from the floor through the nozzle. A handle is connected to the base for propelling the base by manually applying a force to the handle. A drive assist motor, which is not configured to drive the fan, has an output shaft coupled to the drive wheel. The controller is operative in a driving mode to power the motor to rotate the drive wheel in a direction corresponding to a direction of the force applied to the handle. The controller is operative in a non-driving mode to refrain from powering the motor to rotate the drive wheel while a user manually applies force to the handle to propel the base over the floor.

Preferably, a switch electrically communicates with the controller to enable a user to manually switch the controller between the driving and non-driving modes. The controller is configured, in the driving mode, to power the motor to rotate the drive wheel at a target speed that is a function of a magnitude of the force applied to the handle. The motor is configured, in the driving mode of the controller, not to electromagnetically resist an external force urging the drive wheel to rotate faster than the target speed. The motor is configured, in the non-driving mode of the controller, not to electromagnetically resist rotation of the drive wheel in either direction.

DESCRIPTION

Figure 1:
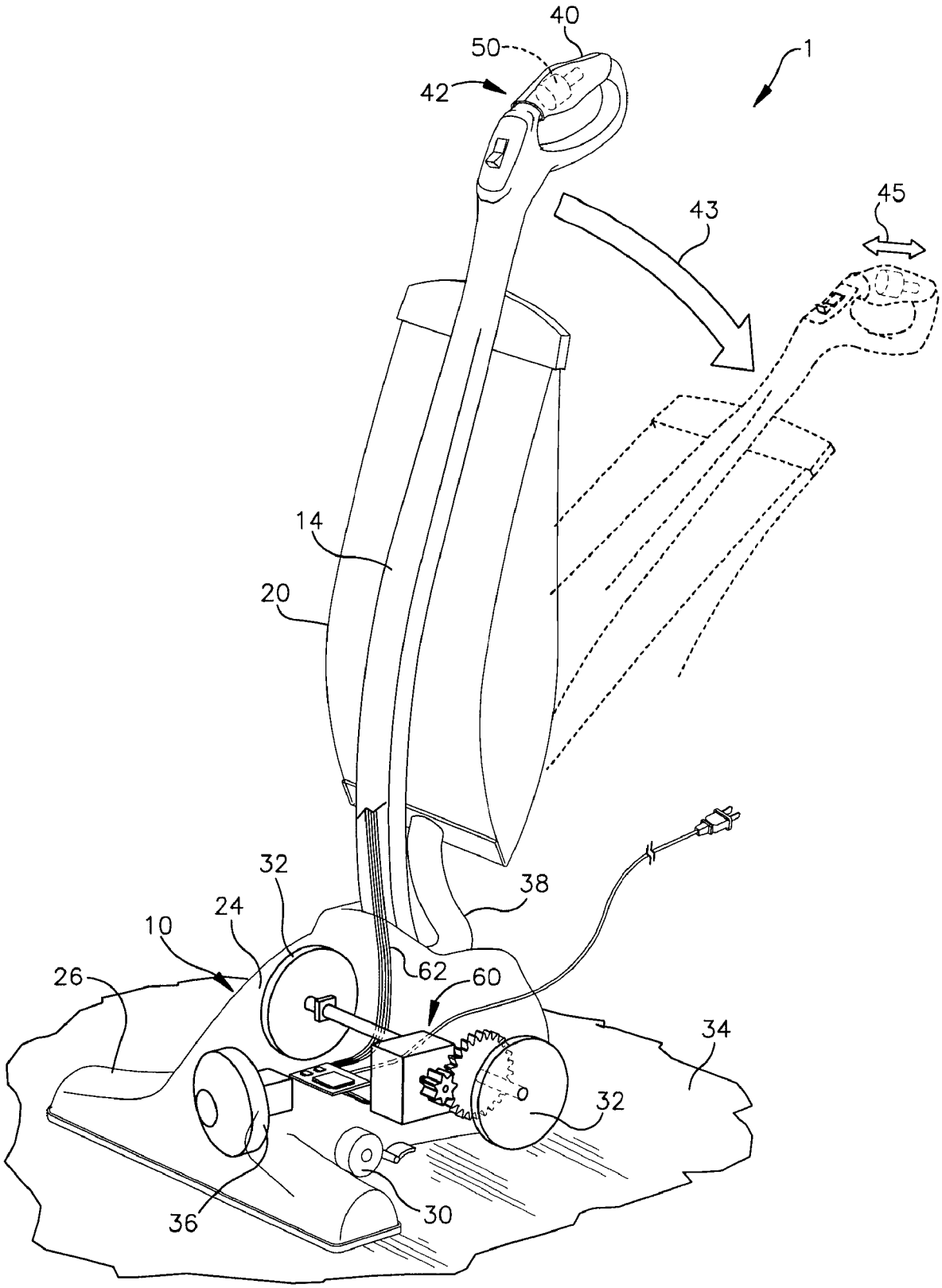
FIG. 1 is a perspective view of a vacuum cleaner.

The apparatus 1 shown in FIG. 1 has parts that are examples of the elements recited in the claims. The apparatus 1 thus includes examples of how a person of ordinary skill in the art can make and use the claimed invention. It is described here to meet the requirements of enablement and best mode without imposing limitations that are not recited in the claims.

The apparatus 1 is a floor cleaning device, in this example a vacuum cleaner. The cleaner 1 includes a base 10, a handle 14 extending upward from the base 10 and a filter bag 20 suspended from the handle 14. The base 10 has a housing 24 defining a cleaning head, which in this example is a vacuuming nozzle. Front and rear wheels 30 and 32 are rotatably connected to the housing 24 to enable wheeling the base 10 over a floor 34. A fan 36 in the housing 24 generates a flow of air that carries dirt from the floor 34, through the nozzle 26, the fan 36 and a fill tube 38, into the filter bag 20.

To move the base 10 about the floor 34, a handgrip 40 of the handle 14 is first grasped by a user. The handle 14 is pivoted backward as indicated by arrow 43. A forward or rearward force is manually applied to the handgrip 40 to push the base 10 forward or pull the base 10 rearward, as indicated by arrow 45. A force sensor 50 in the handle 14 outputs a signal indicative of the direction and magnitude of the force applied to the handgrip 40. A wheel drive assembly 60 in the housing 24 receives the signal through electrical lines 62. The drive assembly 60 rotates the rear wheels 32 in a direction corresponding to the direction of the force applied to the handle 14, and with a torque and speed that are positively related to the magnitude of the force. The rear wheels 32 function as drive wheels in propelling the base 10. The drive assembly 60 thus assists the user in wheeling the base 10 about the floor 34.

Figure 2:
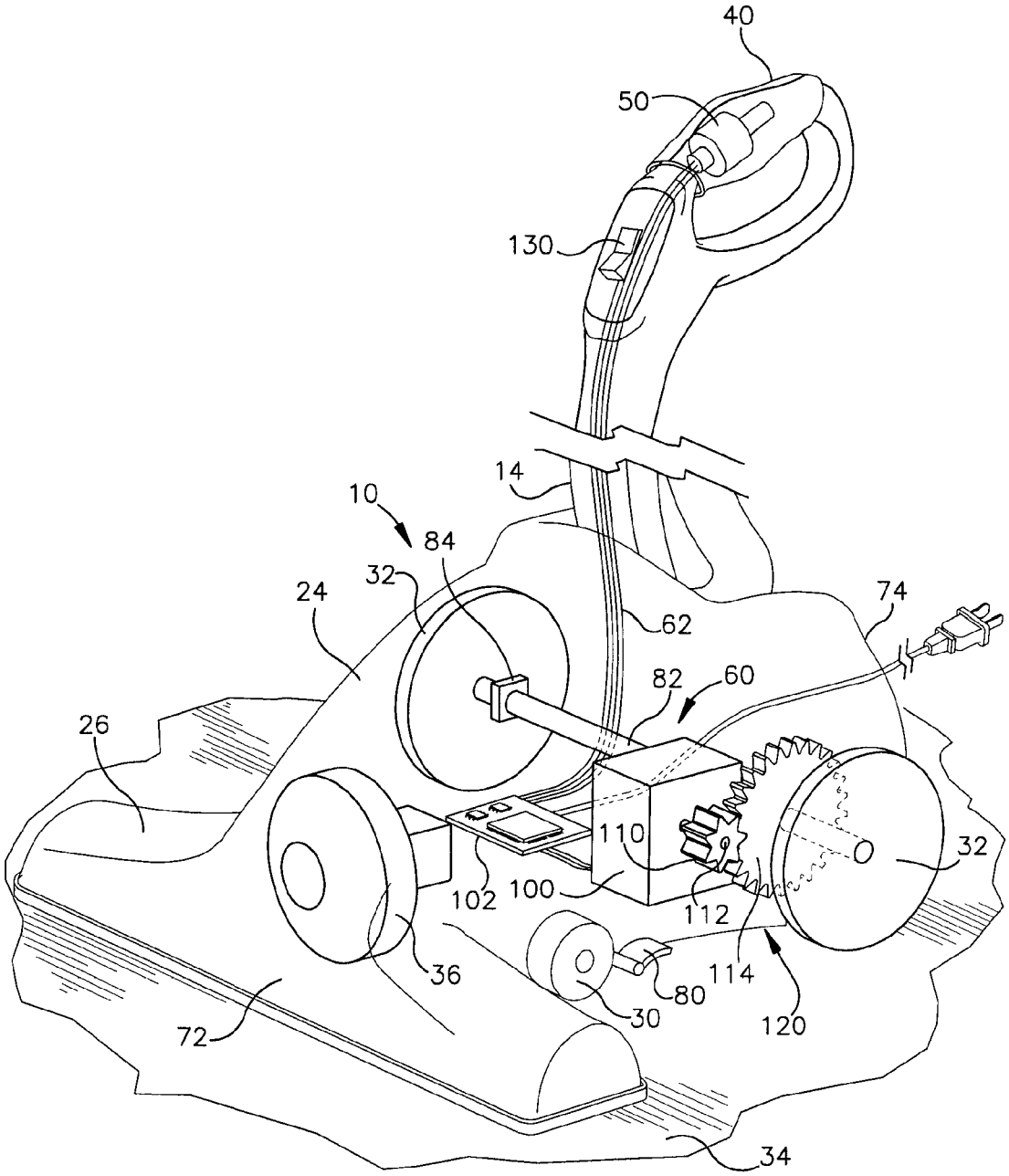
FIG. 2 is an expanded view of a base and a handle of the vacuum cleaner.

As shown in FIG. 2, the base 10 has front and rear ends 72 and 74. The nozzle 26 is at the front end 72, and the handle 14 extends upward from the rear end 74.

The front wheels 30 are rotatably connected to the housing 24 by a height-adjust mechanism 80 that enables the user to raise and lower the nozzle 26 relative to the floor 34. The rear wheels 32 are fixed to a common rear axle 82 that is rotatably connected to the housing 24 by bearings 84 (only one shown).

The drive assembly 60 is housed by the housing 24. It includes a motor 100 secured to the housing 24. This motor 100 is dedicated to rotating the wheels 32 and does not drive the fan 36. An electronic controller 102 is electrically connected to both the motor 100 and the sensor 50. A pinion gear 110, fixed to an output shaft 112 of the motor 100, drives a ring gear 114 fixed to the rear axle 82. The gears 110 and 114 and the axle 82 together comprise a coupling mechanism 120 that couples the drive wheels 32 to the motor shaft 112. The mechanism 120 rotates the drive wheels 32 one turn per set number of turns of the motor shaft 102. The set number is less than ten, preferably less than five, and more preferably one or about one. The coupling mechanism 120 uses gears to achieve a gear reduction, as in FIG. 2, and/or belts and pulleys. The gear reduction is in a single stage to reduce friction.

In operation, the user applies forward or rearward force to the handgrip 40 to push the base 10 forward or pull it rearward. The force sensor 50 sends a signal through the electrical lines 62 to the controller 102, indicating the direction and magnitude of the force. In response, the controller 102 applies a voltage to drive current through the motor 100 to rotate motor shaft 112, and thus the wheels 32, in a direction corresponding to the direction of the force applied to the handle 14, with a torque and speed corresponding to the magnitude of the force.

The controller 102 is programmed to drive the motor 100 with a voltage regulated to rotate the drive wheels 32 at a target speed that is a function of the magnitude of the force applied to the handle 14. The target speed is the speed that the wheels 32 would rotate if no external force or load were applied to the wheels 32 urging them to rotate faster or slower than the target speed. An external force or load is a force or load applied by a structure external to the drive assembly 60.

Examples of external loads urging the wheels 32 to rotate slower than the target speed include friction of the nozzle 26 against the floor 34, drag on the wheels 30 and 32 by plush carpet pile, and abutment of the base 10 against a wall. An example of an external force urging the wheels 32 to rotate faster than the target speed occurs when a user initially applies a large forward force on the handle 14 to move the base 10 forward at a fast speed and suddenly reduces force on the handle 14. Inertia urging the base 10 to continue forward at the fast speed urges the wheels 32 to continue rotating at a speed greater than the target speed. Due to the external forces and loads described above, an actual speed at which the drive wheels 32 are actually turning is different than the target speed.

An example of the relationship between the target speed and the magnitude of the force applied to the handle 14 is as follows. For a force magnitude from 0 to 0.5 lbs, the target speed is zero, and the controller 102 does not electrically drive the motor 100. For a force magnitude from 0.5 to 2 lbs, the target speed increases linearly with magnitude from 0 rpm to a predetermined maximum rpm. For a force magnitude greater than 2 lbs, the target speed is the maximum rpm.

The motor 100 in this example is a brushless three-phase permanent magnet motor, configured for forward and reverse rotation in agreement with the direction the base 10 is moving. The motor 100 is configured to resist an external force urging the wheels 32 to rotate slower than the target speed. The motor 100 does this by drawing more current from the controller 102 to generate more torque to overcome the external force. The torque is generated electromagnetically by interaction between coils, or between a magnet and a coil, within the motor 100.

However, the motor 100 is configured not to electromagnetically resist an external force urging the wheels 32 to rotate faster than the target speed. Such an external force can occur through inertia as explained above. It can also occur when the user pushes the handle 14 with a force larger than the 2 lb limit mentioned above. Resistance to an external force is electromagnetic when it is produced by a magnetic interaction between coils, or between a magnet and a coil, within the motor 100.

This is in contrast to common alternative motors that do electromagnetically resist an external force urging the shaft to rotate faster than the target speed. In such motors, the electromagnetic resistance can be produced by the motor functioning as a generator, generating a voltage greater than the voltage applied by the controller. This causes the current to flow in a reverse direction, opposite from the direction in which the controller applies the current to the motor to power the motor.

The controller 102 is connected to a switch 130 on the handle 114, in front of the handgrip 40. The user can use the switch 130 to switch the controller 102 between a driving mode and a non-driving mode. In the driving mode, the controller 102 powers the motor 100 in response to the handle force as described above.

In the non-driving mode, the controller 102 operatively refrains from powering the motor 100 even when the handle 14 is pushed or pulled. When the motor 100 is not powered, the drive wheels 32 can freewheel. This is due to several factors, including the motor not electromagnetically resisting shaft rotation in either the forward or rearward direction, low speed reduction ratio described above, low number of stages (i.e., one), sufficiently low cogging force of the motor 100, and sufficiently low friction in the motor 100 and the coupling mechanism 120. The user can then propel the base 10 by pushing and pulling the handgrip 40 without assistance from the drive assembly 60, and without having to first disengage the motor 100 or the coupling mechanism 120 from the drive wheels 32. Accordingly, the motor 100 can be permanently connected to the coupling mechanism 120, and the coupling mechanism 120 can be permanently connected to the wheels 32. The base 10 is thus free of an uncoupling mechanism for uncoupling the motor 100 from the wheels 32 such as by disconnecting the coupling mechanism 120 from the drive wheels 32.

In this example, the switch 130 is a rocker switch, which can be pivoted between an on position and an off position. The pivoting action requires only a momentary manual engagement of the switch by a user's finger, entailing flipping the switch and then releasing it. The controller 102 is brought into and remains in the driving mode by the momentary manual engagement moving the switch 130 to the on position. Similarly, the controller 102 is brought into, and remains in, the non-driving mode by the momentary manual engagement moving the switch 130 to the off position. Continued manual contact is not required for the controller 102 to remain in either the driving or non-driving mode.

Alternatively, the switch 130 can be a pushbutton toggle switch. In that case, the controller 102 would be brought into and remain in the driving mode by momentary manual engagement of the toggle switch, entailing pressing the toggle switch once. Similarly, the controller 102 would be brought into and remain in the non-driving mode by momentary manual engagement of the toggle switch, entailing pressing the switch again.

In this example, the floor cleaning device 1 is a vacuum cleaner in which the cleaning head is a vacuuming nozzle 26. In another example, the floor cleaning device 1 is a shampooer in which the cleaning head is a shampooing attachment with brushrolls for brushing shampooing into a carpet. Alternatively, the drive assist assembly can be part of a device that is not for cleaning and thus lacks a cleaning head.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have elements that do not differ from the literal language of the claims, or if they include equivalent structural elements with insubstantial differences from the literal language of the claims.

The invention claimed is:

1. An apparatus comprising:

a base having wheels, including a drive wheel, for wheeling the base over a floor;

a fan in the base;

a nozzle fixed to the base for the fan to draw air from the floor through the nozzle;

a handle connected to the base for propelling the base by manually applying a force to the handle;

a drive assist motor, not configured to drive the fan, having an output shaft coupled to the drive wheel; and a controller operative in different modes, including:

a driving mode in which the controller powers the motor to rotate the drive wheel in a direction corresponding to a direction of the force applied to the handle; and a non-driving mode in which the controller refrains from powering the motor to rotate the drive wheel while a user manually applies force to the handle to propel the base over the floor while the shaft remains coupled to the drive wheel such that rotating the drive wheel causes the shaft to rotate.

2. The apparatus of claim 1 further comprising a switch electrically communicating with the controller to enable a user to manually switch the controller between the driving mode and the non-driving mode.

3. The apparatus of claim 1 wherein the controller is configured, in the driving mode, to power the motor to rotate the drive wheel at a target speed that is a function of a magnitude of the force applied to the handle.

4. The apparatus of claim 3 wherein the motor is configured, in the driving mode of the controller, not to electromagnetically resist an external force urging the drive wheel to rotate faster than the target speed.

5. The apparatus of claim 1 wherein the motor is configured, in the non-driving mode of the controller, not to electromagnetically resist rotation of the drive wheel in either forward or reverse direction.

6. The apparatus of claim 1 further comprising a coupling mechanism by which the shaft is coupled to the drive wheel, configured to rotate the drive wheel one turn per set number of turns of the shaft, the set number being less than ten.

7. The apparatus of claim 1 wherein the shaft is permanently coupled to the drive wheel.

8. An apparatus comprising:

a base having wheels, including a drive wheel, for wheeling the base over a floor;

a handle connected to the base for propelling the base by manually applying a force to the handle;

a motor in the housing having an output shaft coupled to the drive wheel; and a controller configured to power the motor to rotate the drive wheel in a direction corresponding to a direction of the force applied to the handle and at a target speed that is a function of a magnitude of the force applied to the handle.

9. The apparatus of claim 8 wherein the motor is configured not to electromagnetically resist an external force urging the drive wheel to rotate faster than the target speed.

10. The apparatus of claim 8 wherein the controller has a non-driving mode in which the controller operatively refrains from powering the motor to rotate the drive wheel and the motor does not electromagnetically resist rotation of the drive wheel in either a forward or reverse direction.

11. The apparatus of claim 8 wherein the base includes a cleaning head configured to clean the floor as the base is moved over the floor.

12. The apparatus of claim 11 wherein the cleaning head is a vacuuming head.

* * * * *